United States Patent [19]

Nagati et al.

[11] 4,135,703

[45] Jan. 23, 1979

[54] MOBILE HOT METAL MIXER

[75] Inventors: Rashed N. Nagati, Mars; Howard M. Fisher; John W. Mrozek, both of New Castle, all of Pa.

[73] Assignee: Pennsylvania Engineering Corporation, Pittsburgh, Pa.

[21] Appl. No.: 818,673

[22] Filed: Jul. 25, 1977

[51] Int. Cl.² ..... C21C 7/00

[52] U.S. Cl. ..... 266/165; 105/183; 105/199 R; 105/265

[58] Field of Search ..... 105/157 R, 158 R, 164, 105/183, 199 R, 265; 266/165, 248; 61/67

[56] References Cited

U.S. PATENT DOCUMENTS

| | | | |
|---|---|---|---|
| 430,353 | 6/1890 | Smith | 61/67 |
| 1,974,532 | 9/1934 | DeFries | 266/165 |
| 3,070,039 | 12/1962 | Mohr | 105/271 |
| 3,589,303 | 6/1971 | Lakin | 105/265 |

FOREIGN PATENT DOCUMENTS

| | | | |
|---|---|---|---|
| 383199 | 2/1908 | France | 61/67 |

*Primary Examiner*—Gerald A. Dost

*Attorney, Agent, or Firm*—Fred Wiviott

[57] ABSTRACT

A hot metal mixer has an elongate hollow vessel mounted for rotation about a longitudinal axis adjacent each end on a cradle, each of which is supported on pairs of parallel trucks disposed on separate sets of rails. Each cradle extends transversely between the trucks of each pair and is coupled to one truck by a spherical bearing and to the other by spherical and roller bearings to permit thermal expansion and contraction, slight track misalignment and travel around curves. A pair of spouts for receiving or pouring metal are disposed in the upper side portion of the vessel and in spaced relation from the top center.

6 Claims, 5 Drawing Figures

FIG. 3
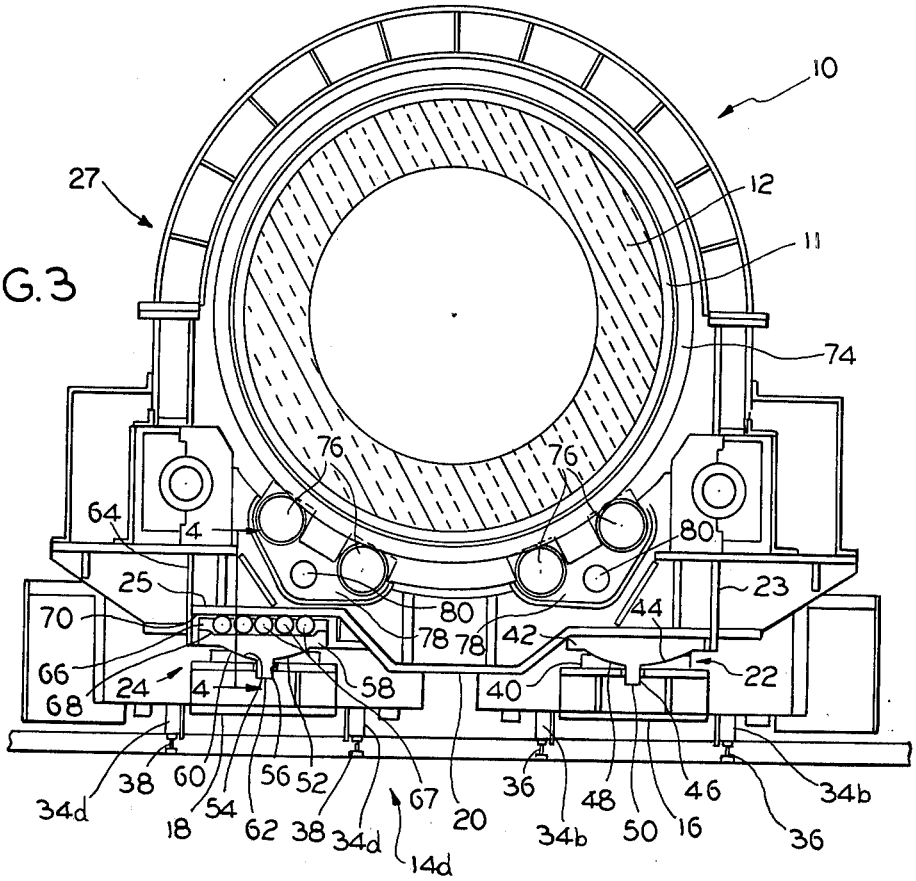
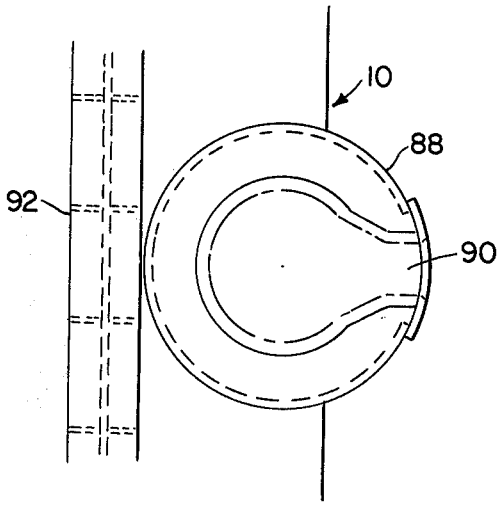
FIG. 5

MOBILE HOT METAL MIXER

BACKGROUND OF THE INVENTION

This invention relates to rail mounted hot metal mixer vessels and more particularly, vessels of relatively large size.

In steel making plants, molten pig iron is commonly transferred from one or more blast furnaces to open hearth furnaces, oxygen converter vessels or other apparatus for further processing. In some plants, it is the practice to transport metal from blast furnaces by means of ladles whose contents are then poured into the open hearth furnace or converter as required. Another common practice is to pour metal from several heats of a blast furnace into a mixer vessel before charging into a metallurgical treatment vessel for further processing. As a result, it is possible to have a supply of molten pig iron on hand for charging to a converter vessel, for example, when necessary and also, the mixing of metal from several blast furnace batches is possible so that composition nonuniformities in different batches may be averaged.

One type of mixer vessel in common use comprises a transportable, elongate refractory lined cylindrical vessel suitably mounted for rotation about a longitudinal axis. Portability of the vessel is achieved by mounting its rotational bearings on spaced apart railroad type trucks with the vessel spanning the gap therebetween. The vessel is also provided with a pouring spout which permits the discharge of molten metal when the vessel is tilted.

While mobile type mixer vessels are relatively large, their size is nonetheless limited by factors relating to axle load capacity and the track gauge. For example, it will be appreciated that as the weight of the vessel increases, the number of axles must correspondingly increase so that the load bearing capacity of the individual axles are not exceeded. This increases overall vehicle length thereby creating handling and stability problems. Also, any increase in vessel diameter correspondingly raises the vehicle center of gravity thereby further contributing to instability problems particularly when traversing occurs.

SUMMARY OF THE INVENTION

It is an object of the invention to provide a new and improved hot metal mixer.

Another object of the invention is to provide a support system for hot metal mixers which permits the use of longer and larger diameter cars without loss of stability.

A further object of the invention is to provide a hot metal mixer vessel and support capable of sustaining relatively large loads.

These and other objects and advantages of the present invention will become more apparent from the details thereof taken with the accompanying drawings.

Figure 1:
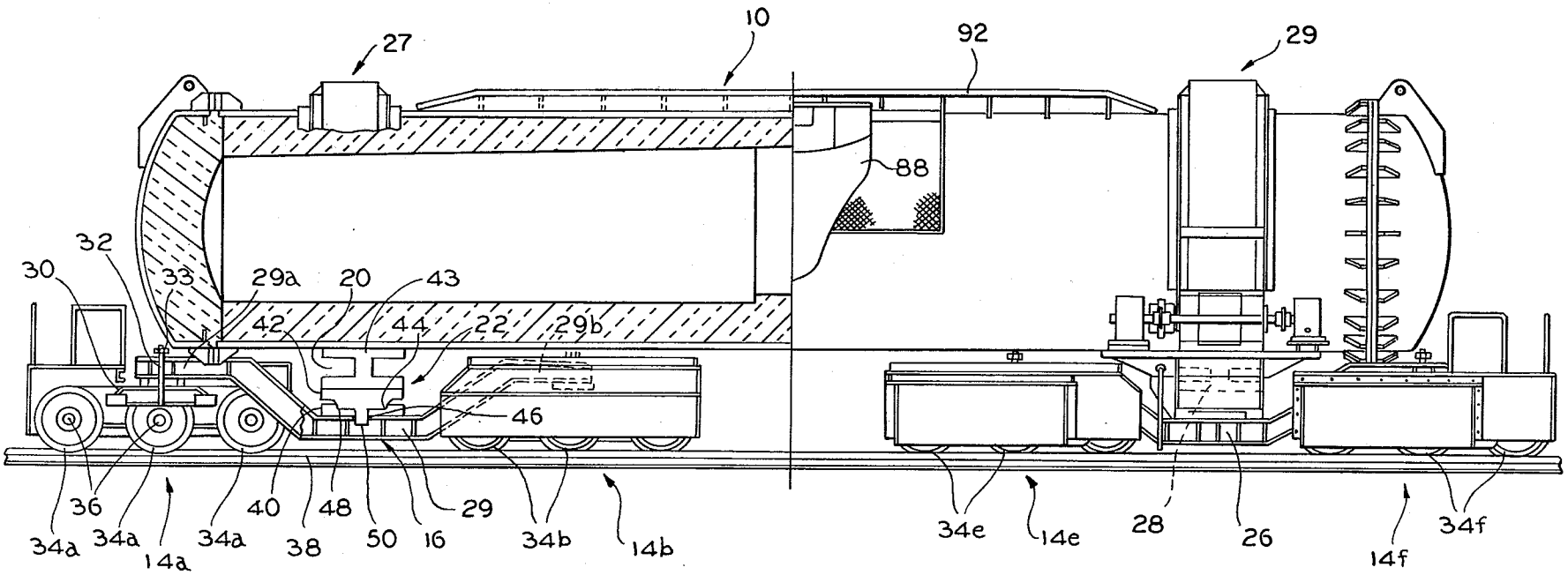
FIG. 1 is a side elevational view of the hot metal mixer car according to the present invention.
Figure 4:
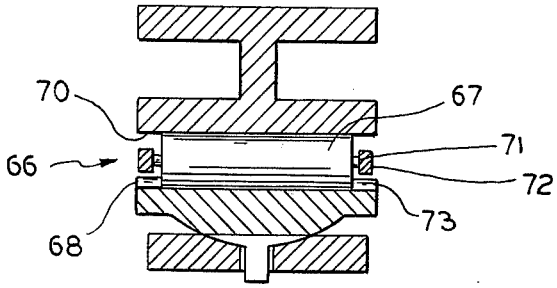

FIG, 2 is an end view of the hot metal mixer illustrated in FIG. 1;

FIG. 3 is an end view of the apparatus of FIG. 1 with parts broken away;

FIG. 4 is a view taken along lines 4—4 of FIG. 3 and;

FIG. 5 is a top plan view of a portion of the apparatus of FIG. 1 illustrating the molten metal pouring spout.

DESCRIPTION OF THE PREFERRED EMBODIMENT

Figure 2:
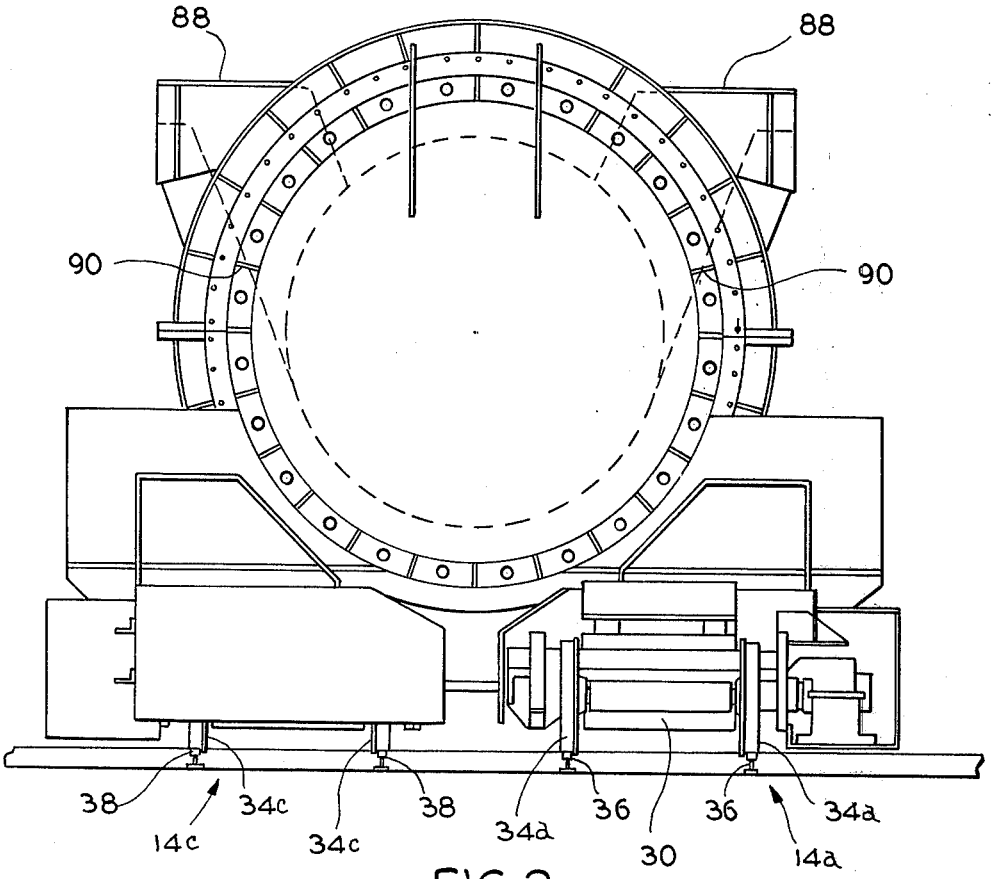

In the preferred embodiment of the invention, a hot metal mixer vessel 10 is supported at each end by two pairs of railroad truck assemblies. Specifically, at the left end of the vessel 10 as viewed at FIG. 1 and at the right side as viewed in FIGS. 2 and 3, there are a first pair of trucks 14*a* and 14*b* which are interconnected by a longitudinally extending bolster 16. A second pair of trucks 14*c* (FIG. 2) and 14*d* (FIG. 3) are disposed on the left side of the vessel 10 as seen in FIGS. 2 and 3 and are interconnected by a longitudinal bolster 18.

One end of the vessel 10 is supported on a cross beam 20 which extends between the bolsters 16 and 18. A first bearing 22 is mounted between one end 23 of cross beam 20 and bolster 16 and a second bearing assembly 24 is disposed between the other end 25 of beam 20 and bolster 18. A third pair of trucks 14*e* and 14*f* are disposed at the opposite end of vessel 10 and are interconnected by longitudinal bolster 26. In addition, a fourth pair of trucks (not seen) are disposed at the opposite side of the vessel and are interconnected by a longitudinal bolster (not shown). A cross beam 28 interconnects the longitudinal bolsters at the right end of the vessel as seen in FIG. 1.

The spherical bearing 22 at one side of the assembly and the spherical bearing 24 and the roller bearing 66 at the other side of the vessel permit expansion and contraction of the vessel without stressing the supporting assembly. In addition, these bearing structures permit relative lateral movement of the trucks on one side of the vessel relative to those on the other as the vessel negotiates curves and in the event the tracks 36 and 38 are not precisely parallel.

The cross beams 20 and 28, respectively, carry roller assemblies 27 and 29 which support the vessel 10 for rotation about its longitudinal axis as will be described more fully below. The longitudinal bolster 16, which is typical, is shown in FIG. 1 to have a central portion 29 lying generally between trucks 14*a* and 14*b* and upwardly and outwardly extending wing portions 29*a* and 29*b*.

Truck 14*a* is also typical and includes a framed portion 30 disposed below wing portion 29*a* and is affixed thereto by a king pin 32 which is threaded at its top for receiving a bolt 33. Truck 14*a* also includes sets of flanged wheels 34*a* mounted on axles 36 which are suitably journaled for rotation on frame portion 32. Truck 14*b* is identical and is similarly affixed to the other wing portion 29*b* of longitudinal bolster 16. It will be appreciated that the remaining pairs of trucks at the other three corners of vessel 10 are similarly affixed to their respective bolsters.

The wheels 34*a*, 34*b*, 34*e* and 34*f*, respectively, of trucks 14*a*, 14*b*, 14*e* and 14*f* are disposed on rails 36. A second pair of rails 38 are arranged in a parallel relation to rails 36 and spaced therefrom for supporting the wheels 34*c* and 34*d*, respectively, of trucks 14*c* and 14*d* as well as the wheels disposed at the opposite corner of the vessel but which are not seen in the drawings. Each of the rails 36 and 38 may be standard gauge and are suitably spaced apart so that they may also be used by other wheeled equipment.

Referring to FIGS. 1 and 3, the bearings 22 are shown to include a spherical socket portion 40 affixed to longitudinal bolster 16 and bearing member 42 which is affixed to the end 23 of cross beam 20. The socket portion 40 includes a concave surface 44 which preferably takes the form of a spherical section and has a central aperture 46. The bearing member 40 has a convex surface 48 which is complimentary to the surface 44 and a central stem portion 50 which extends downwardly through the opening 46 in member 40. The opening 46 is larger than the diameter of stem 50 so that there may be relative rocking movement of members 40 and 42.

The bearing 24 at the opposite side of the vessel also includes a socket portion 52 affixed to the longitudinal bolster 18 and has a concave surface 54 which is a spherical section and a central aperture 56. In addition, there is a bearing member 58 which is similar to member 42 and which has a convex bearing surface 60 which is complimentary to the surface 54 and a stem 62 which extends loosely through opening 56. Disposed between bearing member 58 and the end 25 of cross beam 20 is a roller bearing 66 consisting of a plurality of elongate, cylindrical bearing members 67 disposed in a parallel relation and transverse to a plane containing the rotational axis of wheels 34*d*. The upper surface 68 of bearing member 58 is recessed to provide a race for the roller bearing 66. The opposite race for roller 66 is provided by the undersurface 70 of the end portion 25 of cross beam 20. It will be noted that the surface 70 is at a higher elevation than the undersurface of the opposite end portion 23 of cross beam 20 so that the two sides of the beam will be relatively horizontal notwithstanding the addition of the roller bearing 66 between bearing member 58 and surface 70. The individual rollers 67 of bearing 66 are each rotatably mounted on an axial shaft 71 which are coupled at their ends by strap members 72. A lip 73 at each end of the surface 68 retains the assembly 66 on said surface.

The drive assembly 30 includes a pair of bands 74 which surround the vessel 10 and are suitably affixed to its surface. Pairs of drive wheels 76 are rotatably mounted on yokes 78 which are in turn pivotally journaled on the cross beams 20 and 26 by means of pins 80. Motive means (not shown) are coupled to each of the rollers 76 for driving the same. The vessel is also mounted for rotation within bearings 27, 29 in any suitable manner so that when the drive wheels 76 are driven, the vessel may tilt between its various positions. The vessel rotational drive mechanism and bearings form no part of the present invention and accordingly, will not be described in further detail. However, for a more complete description of the drive mechanism and bearings suitable for use with the present invention, reference is made to U.S. Pat. No. 3,589,303.

The vessel 10 is provided with a pair of pouring spouts which are connected by channels 90 to the interior of vessel 10 so that when the vessel is pivoted about its longitudinal axis, the molten metal contents of the vessel may be discharged. The position of the pouring spouts is such that the discharge of molten metal will be to the side of vessel 10 and outside the rails 36 and 38. The spouts at each side are also located above the corresponding tracks at each side of the vessel so that the discharge of metal will be to the side of the vessel and outside the rails 36 and 38. Also, the spouts are positioned to receive molten metal from feed troughs above each track. It can also be seen that the channels 89 which form a discontinuity in the vessel, are displaced from the top center line. As a result, the channel structure is not required to bear the compressive loads which exist in the top of the vessel. This also permits the use of a stiffening spine which consists of an elongate structural member 92 affixed to the vessel along its upper surface for carrying such loads.

We claim:

1. An elongate vessel for containing a molten metal charge, first and second pairs of truck means disposed respectively at the opposite ends of the vessel for supporting the same, said vessel bridging the gap between said pairs of truck means and interconnecting the same, each pair of truck means including a first truck means disposed at one side of said vessel and having pairs of wheels adopted to engage a first set of parallel rails and a second truck means disposed at the opposite side of said vessel and having pairs of wheels adapted to engage a second set of parallel rails disposed adjacent said first set and being oriented relatively parallel with respect thereto, cross beam means interconnecting said first and second truck means of each pair, vessel rotating means being disposed on each of said cross beam means, a first bearing means disposed between each of the first truck means of each pair and one end of each said cross beam means and a second bearing means disposed between the opposite end of each cross beam means and its associated second truck means, each of said first bearing means include first and second members, each said first members being affixed to its associated cross beam means and each said second bearing members being affixed to its associated first truck means, one of said first and second bearing members having a concave surface and the other a complimentary convex surface which permits universal pivotal movement between each first truck means and its respective cross beam means, each said second bearing means including third and fourth bearing members, one of said third and fourth bearing members having a concave surface and the other having a complimentary convex surface to permit relative universal pivotal movement therebetween, said third bearing members being mounted on their respective second truck means, and roller bearing means disposed between each said fourth bearing means members and the other end of its associated cross beam means to permit limited relative lateral movement between each said first and second truck means.

2. The apparatus set forth in claim 1 wherein each of said truck means comprises at least a pair of individual trucks spaced apart in the axial direction relative to said vessel, longitudinal bolster means extending in said axial direction and interconnecting said trucks, whereby there is a pair of parallel bolsters disposed at each end of said vessel and spaced apart longitudinally, each of said first and third bearing members respectively being mounted on one of said bolsters, said cross beam means being disposed above and extending generally normal to said bolsters.

3. The assembly set forth in claim 1 wherein each of said first and third bearing members has a concave surface which is a spherical section and each of said second and fourth bearing members has a complimentary convex surface, an aperture formed in a central portion of each of said first and third bearing members, each of said second and fourth bearing members having a stem means extending therefrom for being loosely received within one of said apertures to limit the pivotal movement between said bearing members.

4. The assembly set fourth in claim 3 wherein said roller bearing means includes a plurality of elongate rollers oriented with their axes perpendicular to planes containing the rotational axis of said pairs of wheels.

5. The apparatus set fourth in claim 4 wherein each of said truck means comprises at least a pair of individual trucks spaced apart in the axial direction relative to said vessel, longitudinal bolster means extending in said axial direction and interconnecting said trucks, whereby there is a pair of parallel bolsters disposed at each end of said vessel and spaced apart longitudinally, each of said first and third bearing members respectively being mounted on one of said bolsters, said cross beam means being disposed above and extending generally normally to said bolsters.

6. The apparatus set forth in claim 5 and including means for rotating said vessel about a longitudinal axis, a pair of pouring spout means each opening into said vessel for discharging metal therefrom when said vessel is rotated from a normal position, said spout means each being located in spaced apart relation from the top center of said vessel and each being located generally above one of said sets of rails when said vessel is in its normal position and elongate stiffening spine means affixed to said vessel between said pouring spout means and extending generally parallel to said longitudinal axis.

* * * * *